US006294095B1

(12) United States Patent
Lewis

(10) Patent No.: US 6,294,095 B1
(45) Date of Patent: Sep. 25, 2001

(54) SILT FILTRATION SYSTEM

(75) Inventor: Randy Lewis, Charlotte, NC (US)

(73) Assignee: Erosion Control Services, Inc., Charlotte, NC (US)

( * ) Notice: Subject to any disclaimer, the term of this patent is extended or adjusted under 35 U.S.C. 154(b) by 0 days.

(21) Appl. No.: 09/556,668

(22) Filed: Apr. 24, 2000

(51) Int. Cl.[7] ..... E03F 5/06

(52) U.S. Cl. ..... 210/747; 210/164; 210/232; 210/477

(58) Field of Search ..... 210/747, 232, 210/170, 163, 164, 456, 485, 477; 404/2, 4; 405/36, 41

(56) References Cited

U.S. PATENT DOCUMENTS

| | | | | |
|---|---|---|---|---|
| 369,457 | * | 9/1887 | Levett . | |
| 2,993,600 | | 7/1961 | Ressler | 210/164 |
| 3,282,430 | * | 11/1966 | Kinne | 210/170 |
| 3,516,541 | | 6/1970 | Hardingham | 210/164 |
| 3,713,539 | | 1/1973 | Thompson et al. | 210/164 |
| 4,419,232 | | 12/1983 | Arntyr et al. | 210/164 |
| 5,284,580 | * | 2/1994 | Shyh | 210/164 |
| 5,345,741 | | 9/1994 | Slater et al. | 52/646 |
| 5,372,714 | | 12/1994 | Logue, Jr. | 210/164 |
| 5,480,254 | | 1/1996 | Autry et al. | 404/2 |
| 5,486,287 | | 1/1996 | Murphy et al. | 210/164 |
| 5,575,925 | | 11/1996 | Logue, Jr. | 210/747 |
| 5,788,849 | | 8/1998 | Hutter, Jr. et al. | 210/163 |
| 5,820,762 | | 10/1998 | Bamer et al. | 210/661 |
| 5,843,306 | | 12/1998 | Singleton | 210/163 |
| 5,849,198 | | 12/1998 | Sharpless | 210/693 |
| 5,985,157 | * | 11/1999 | Leckner et al. | 210/747 |
| 6,045,691 | * | 4/2000 | McDermott | 210/164 |
| 6,086,758 | * | 7/2000 | Schilling et al. | 210/164 |
| 6,149,803 | * | 11/2000 | DiLoreto, Jr. et al. | 210/170 |

* cited by examiner

*Primary Examiner*—David A. Simmons
*Assistant Examiner*—Frank M. Lawrence
(74) *Attorney, Agent, or Firm*—Kennesy Covington Lobdell & Hickman, LLP

(57) ABSTRACT

A silt filtration system for use with storm water catch basins of the type which include a fixed frame with a drain opening at the top of the catch basin and a grate covering the drain opening and includes a base frame having a pair of end rails and a pair of side rails adapted to fit within the fixed frame at the top of the catch basin. The silt filtration system also includes a pair of lengthwise support bars or rods which are removably positioned within the base frame and a pair of transverse support bars or rods which are removably positioned over the lengthwise support bars and supported by the side rails. The lengthwise and transverse bars suspend a filter bag within the catch basin which includes a pocket at the top end for receiving the lengthwise support bars and the transverse support bars. The silt filtration system may include a deflector for deflecting silt and/or sediment and the like over the grate and into the filter bag. A method for installing the silt filtration system includes the steps of: lifting the grate from the drain and placing the base frame on the fixed frame of the catch basin, inserting the lengthwise support bars through the pockets of one pair of opposite sides at the top end of the filter bag and dropping the filter bag into the catch basin with the lengthwise bars positioned in the holders to support the sides of the bag. Further steps include: inserting the transverse support bars into the pockets of the remaining opposite sides at the top end of the filter bag, replacing the grate on top of the silt filtration system and installing the deflector on the grate.

21 Claims, 7 Drawing Sheets

SILT FILTRATION SYSTEM

BACKGROUND OF THE INVENTION

The present invention relates generally to filter systems, and more particularly to a filtration system for storm water drains for filtering silt from wastewater flowing into street curb drains.

A storm sewer system helps prevent flooding by diverting rain and melted snow into the nearest river or creek through a network of underground pipes. Surface water enters the storm sewer system through curb-side street drains and flows by gravity to the outfalls, where the water is discharged into a creek or river. Since pollutants can enter the storm sewer system through street drains, local waterways can be damaged when debris is carried into the drain along with the surface water. This is a particular problem in areas where new construction is taking place. Regardless of how thoroughly builders may maintain a construction project, silt is likely to accumulate on the streets and is blown into the curb-side street drains, and into the water system, by rain and/or large street-washing trucks.

A street curb drain typically includes a storm water catch basin, a fixed frame with a catch basin inlet and a grate covering the drain opening. Examples of silt catching devices for use with street drains are shown in U.S. Pat. Nos. 4,419,232 and 5,575,925. The devices include a silt filtering bag which is constructed of a fabric designed to capture the silt while allowing the water to flow therethrough. In U.S. Pat. No. 5,575,925, the filter bag includes a plurality of lift flaps which are designed to extend between the grate covering and the catch basin inlet so that the grate covering sandwiches the flaps in place against the catch basin for supporting the filter bag in the catch basin.

One disadvantage of this silt catching device is that it requires the edges of the filter bag to be placed at street level. Thus, the fabric edges of the bag are exposed to vehicular traffic and may become frayed and/or ripped. Whe n the bag is ready to be emptied, there may be no fabric or not enough fabric to handle the weight of the silt-filled bag thereby causing the bag to fall into the drain. In this event, a person must be lowered into the drain and remove the silt with buckets which are passed to people at the street level to clean out the drain. The cleaning out of a silt-filled drain is a difficult and time-consuming task.

Another disadvantage of silt catching devices is that the filter bag may be too deep and too wide for the catch basin. Thus, during a hard rain, the sack may press against the sides of the drain thereby preventing water from passing, through the sack and causing the streets to flood. A further disadvantage of current silt-catching devices is that the design and location of such devices at street level may force silt to build up in the street while affording minimal overflow capabilities during hard rain. Therefore, there is a need for a simple, readily accessible silt trap system which effectively catches the silt and allows the silt to be safely and easily removed.

SUMMARY OF THE INVENTION

In accordance with the present invention, a silt filtration system is provided for use with storm water catch basins for filtering silt from wastewater flowing into street curb drains. The silt filtration system is designed to be used with a street curb drains of the type which include a storm water catch basin having a fixed frame with a drain opening at the top of the catch basin and a grate covering the drain opening. The silt filtration system is uniquely configured to allow for the quick and easy removal of the silt captured by the system.

Because the silt filtration system of the present invention is specifically designed to fit beneath the grate, it is located entirely beneath the street level and is not exposed to vehicular traffic or the elements. Thus, the system may be used repeatedly and moved to different locations as needed, such as, by way of example, to new phases of a construction project.

The silt filtration system of the present invention comprises a base frame adapted to fit within the fixed frame at the top of the catch basin of the curb drain. The base frame includes a pair of spaced apart end rails which are mounted beneath the grate and rest on a series of bumps or ridges located on the fixed frame of the catch basin on which the grate covering, normally rests. The end rails are connected by a pair of spaced apart side rails which extend between the end rails to form the base frame. The silt filtration system also includes a pair of lengthwise support bars or rods which are removably positioned within the base frame and supported by a plurality of holders or brackets attached to the base frame. Each holder includes a recess for receiving and supporting the lengthwise bars therein. In addition, the system includes a pair of transverse support bars or rods which are removably positioned over the lengthwise support bars and supported by the side rails.

The lengthwise and transverse bars of the present invention are designed to suspend a filter bag within the catch basin for capturing the silt in the water flowing into the catch basin. The filter bag of the present invention includes two pairs of opposite sides and an open top end. Each side of the bag includes a pocket or sleeve at the top end for receiving the lengthwise support bars and the transverse support bars. Because of the unique combination and configuration of the frame mountable beneath the grate and the two pairs of support bars, the entire system is advantageously located beneath the grate and below the street level.

In the preferred embodiment of the present invention, the base frame of the present invention is substantially rectangular shaped and is constructed of a rigid, durable material, such as by way of example, steel. Each end rail is substantially L-shaped and includes a first portion and a second portion. The first portion is adjacent to the drain opening and mountable to the fixed frame of the catch basin. The second portion is attached to the first portion and extends downwardly into the catch basin. In the preferred embodiment, the side rails are connected to the second portion of the end rails and are positioned a predetermined distance below the first portion of the end rails and the drain opening. Each holder recess is substantially v-shaped and extends below the side rails for supporting the lengthwise support bars thereon in substantially horizontal alignment with the side rails. In use, the transverse support bars are positioned over the lengthwise support bars and rest on the side rails to suspend the filter bag in the catch basin. In the preferred embodiment, each side rail includes a raised portion for holding the transverse support bars in place adjacent to the end rails.

The filter bag of the subject invention is constructed of any suitable fabric or material which allows water to flow therethrough while capturing silt within the bag and is preferably constructed of a general use, high-strength, high-modulus fabric, such as, by way of example, the woven geotextile fabric known as GTF-200 manufactured by LINQ Industrial Fabrics, Inc. In the preferred embodiment, the width of the filter bag narrows as it descends into the catch basin for advantageously preventing the bag from pressing against the sides of the return basin and blocking the water from passing through the sides of the sack. In addition, the subject invention may include a means for deflecting silt and/or sediment and the like to flow over the grate and into the filter bag for increasing the effectiveness of the subject invention. In the preferred embodiment, the means is an elongated rail or deflector positioned on the grate adjacent to the curb.

The present invention may also include a method for installing the silt filtration system on a street curb drain and removing the silt from the drain. In the preferred embodiment, the steps for installing the silt filtration system begin with lifting the grate from the drain and placing the base frame on the fixed frame of the catch basin on which the grate normally rests. Next, the lengthwise support bars are inserted through the sleeves of one pair of opposite sides at the top end of the filter bag. Holding the lengthwise support bars, the filter bag is dropped into the catch basin and the lengthwise bars are positioned in the holders to support the sides of the bag. The transverse support bars are inserted into the sleeves of the remaining opposite sides at the top end of the filter bag to support the bag within the catch basin. After all of the bars are in place, the grate is replaced on top of the silt filtration system and the deflector may be positioned on the grate for deflecting silt and/or sediment and the like to go over the grate and into the filter bag. Thus, the silt filtration system is quickly and easily installed and, except for the deflector, is completely below the street level, thereby avoiding vehicular traffic and damage to the filter bag. To empty the silt collected in the filter bag, the grate is removed and the bars are lifted from the base frame to easily raise the filter bag from the catch basin. After the silt is emptied from the bag, the filter bag may be returned to the catch basin for repeated use of the silt filtration system at the same location or the system may be moved to catch basins at different locations, as needed, and repeatedly used to effectively capture the silt entering the drain and allow for safe and easy removal of the silt.

DESCRIPTION OF THE PREFERRED EMBODIMENT

Figure 1:
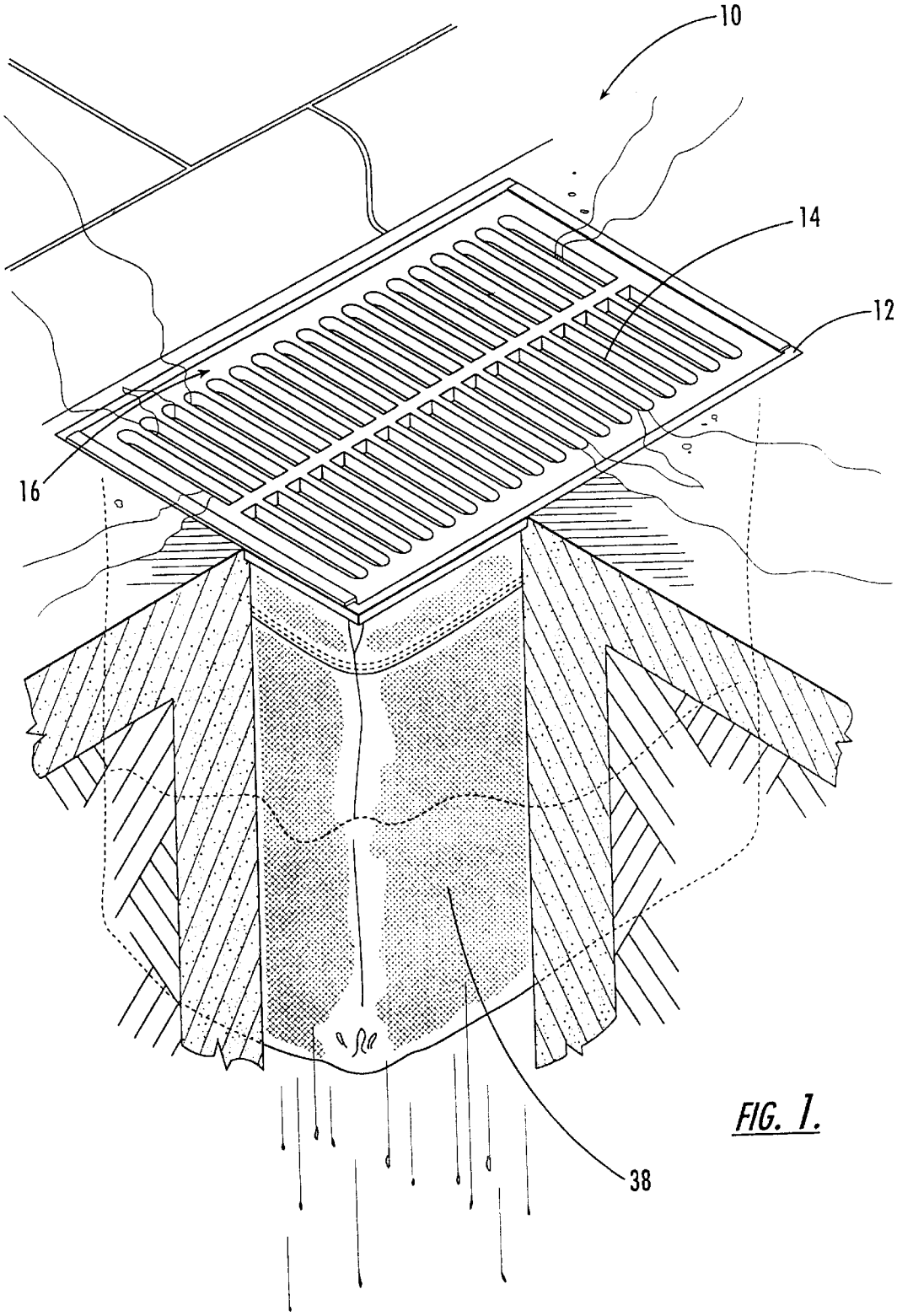
FIG. 1 illustrates the silt filtration system according to the preferred embodiment of the invention mounted in a storm water catch basin in a street curb drain.
Figure 2:
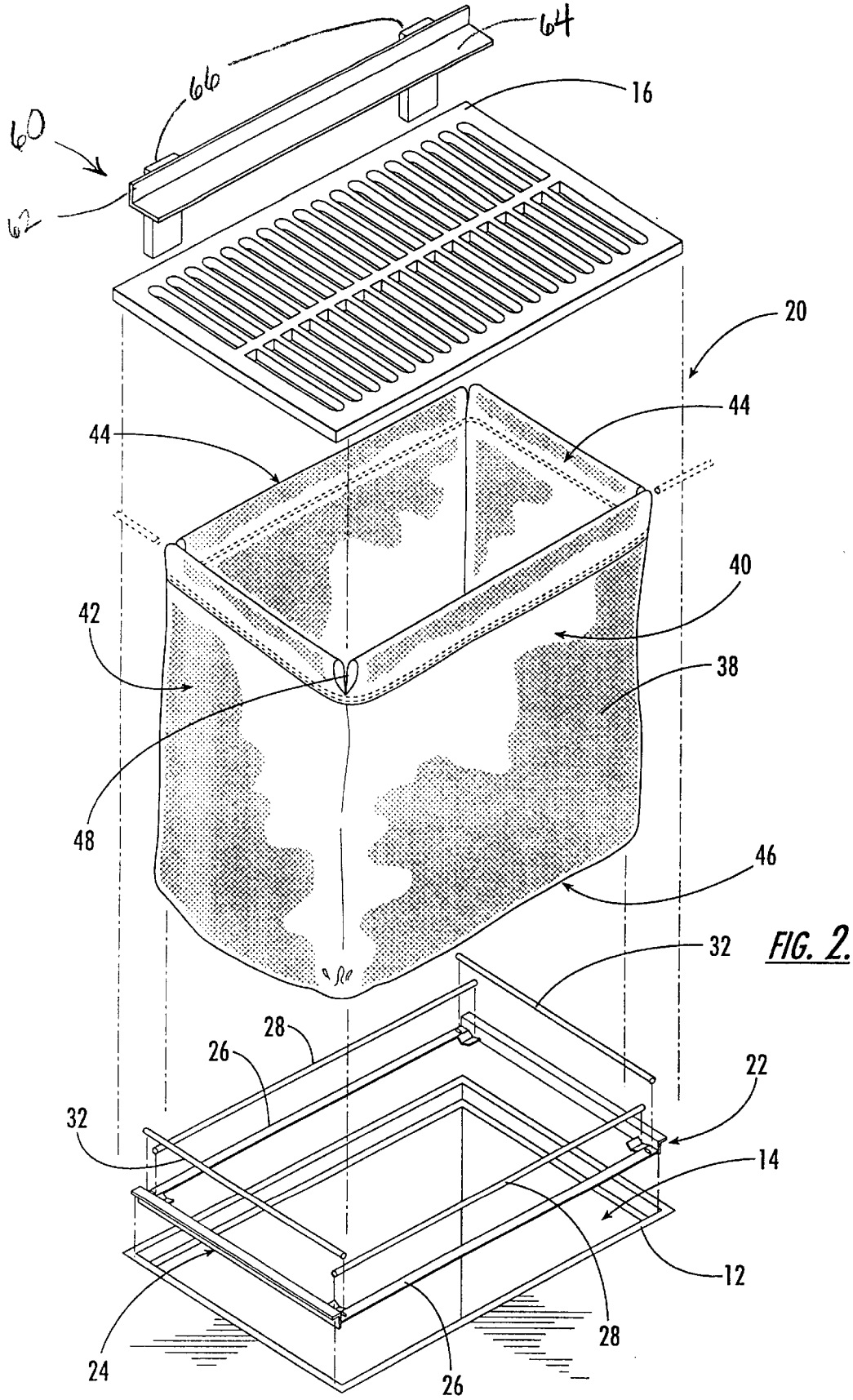
FIG. 2 is an exploded view of the components forming the silt filtration system of the preferred embodiment and showing a deflector which may be included.

Looking now in greater detail at the accompanying drawings, a silt filtration system embodying the present invention is provided for use with street curb drains of the type having a storm catch basin 10 which includes a fixed frame 12 with a drain opening 14 at the top of the catch basin and a grate 16 covering the drain opening. As can be seen in FIGS. 1 and 2, the fixed frame 12 is substantially rectangular-shaped and includes a series of ridges or bumps on which the grate 16 rests when in place covering the drain opening 14. The storm catch basin 10 is located adjacent to a street curb and the grate 16 is substantially flush with the street level.

Figure 3:
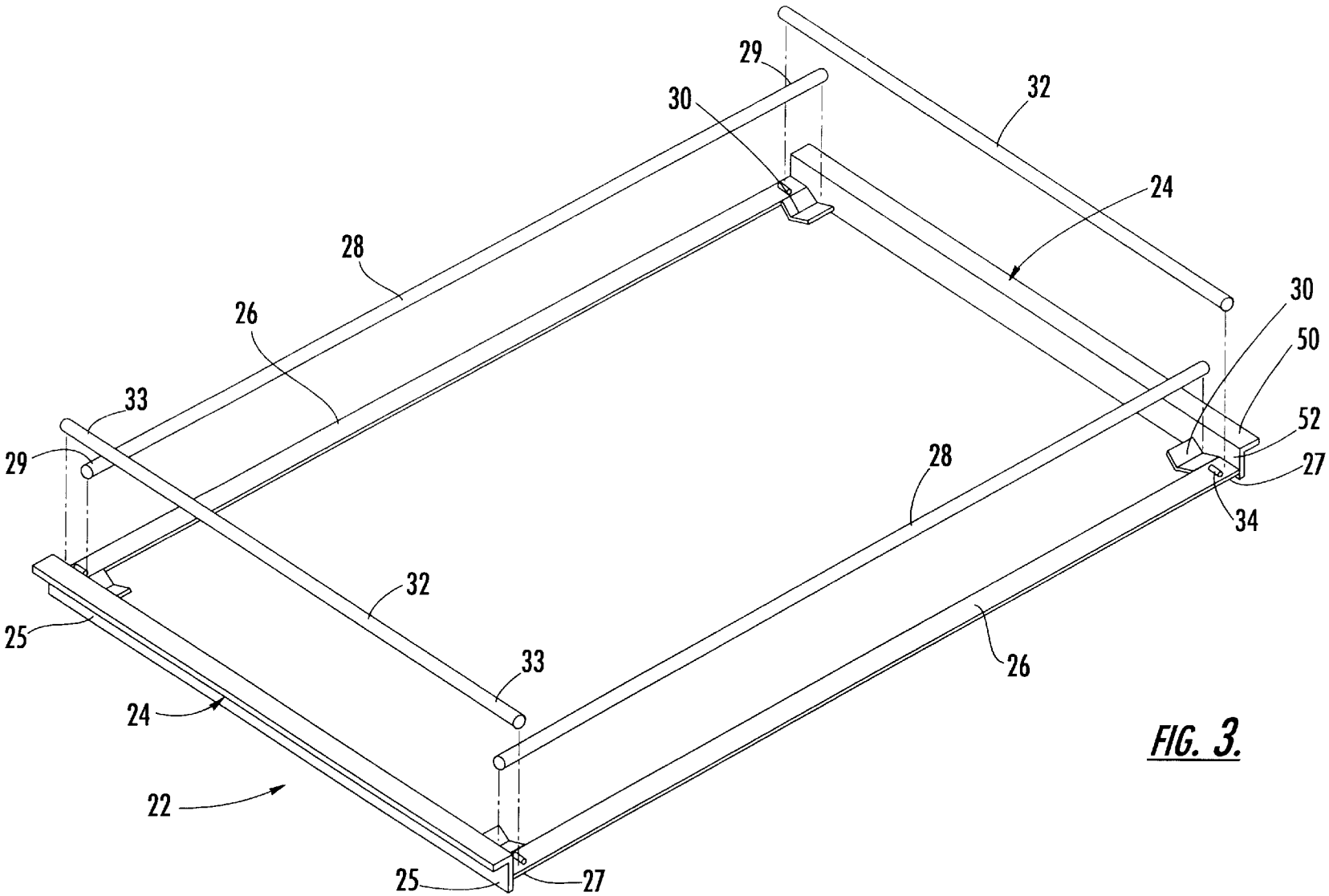
FIG. 3 is a perspective view of the preferred embodiment showing an exploded view of the base frame and the bars positioned thereon, without the filter bag.
Figure 4:
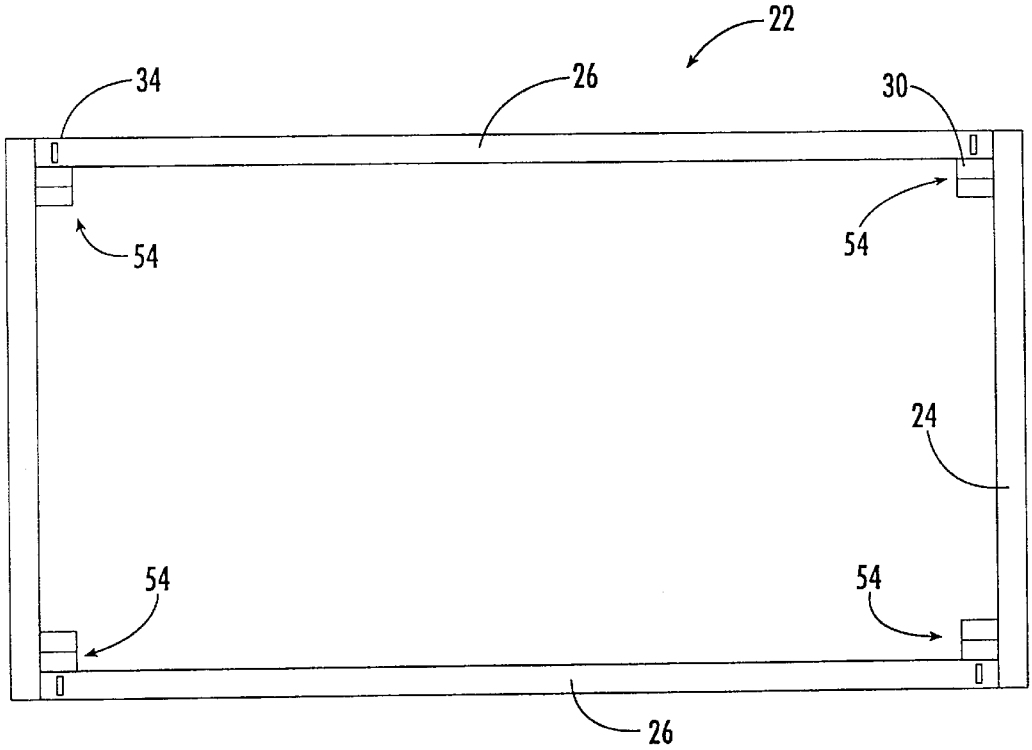
FIG. 4 is a top view of the base frame of the preferred embodiment of the invention.
Figure 5:
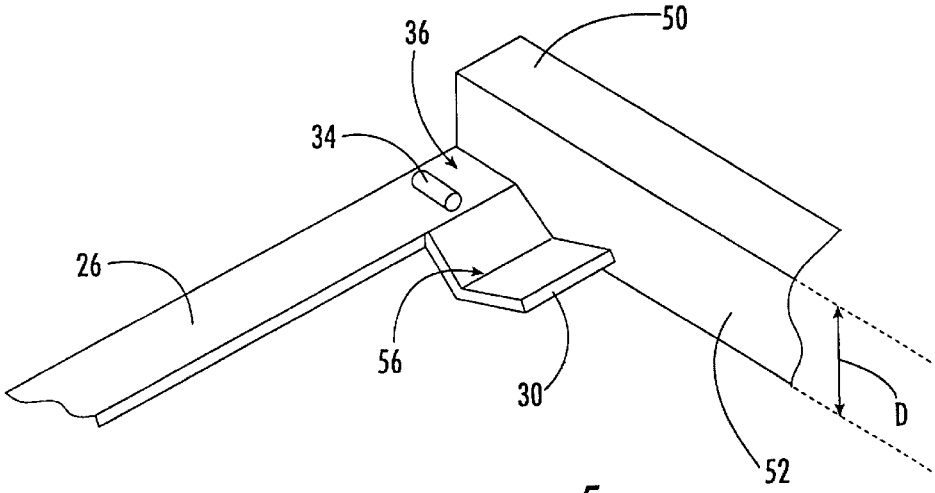
FIG. 5 is an enlarged, perspective, partial view of the base frame showing a bracket for supporting a lengthwise support rod and a ridge for preventing movement of a transverse support rod positioned over the lengthwise support rod.

As illustrated in FIGS. 1–6, the preferred embodiment of a silt filtration system 20 includes a base frame 22 adapted to fit within the fixed frame 12 under the grate 16. As best seen in FIG. 3, the base frame 22 is substantially rectangular-shaped and includes a pair of spaced-apart end rails 24 with opposite ends 25 and a pair of spaced-apart side rails 26 with opposite ends 27. The side rails 26 extend between and each end 27 is connected to ends 25 of the end rails 24 to form the base frame 22. The system 20 also includes a pair of lengthwise support bars or rods 28 having opposite ends 29 and a plurality of holders or brackets 30 attached to the base frame 22 for receiving and supporting the ends 29 of the lengthwise support bars 28. The lengthwise support bars 28 are removably positioned within the base frame 22 on the holders 30 and extend between the end rails 24 adjacent to the side rails 26. As shown in FIGS. 2 and 3, the system 20 includes a pair of transverse support bars 32 which are removably positioned over the lengthwise support bars 28 and have opposite ends 33 which rest on the side rails 26. As best seen in FIGS. 4 and 5, each side rail 26 includes a raised portion or ridge 34 near each end 27 forming a channel 36 between the raised portion 34 and each end rail 24 for holding the ends 33 of the transverse support bars 32 in place adjacent to the end rails 24 on the base frame 22.

Figure 6:
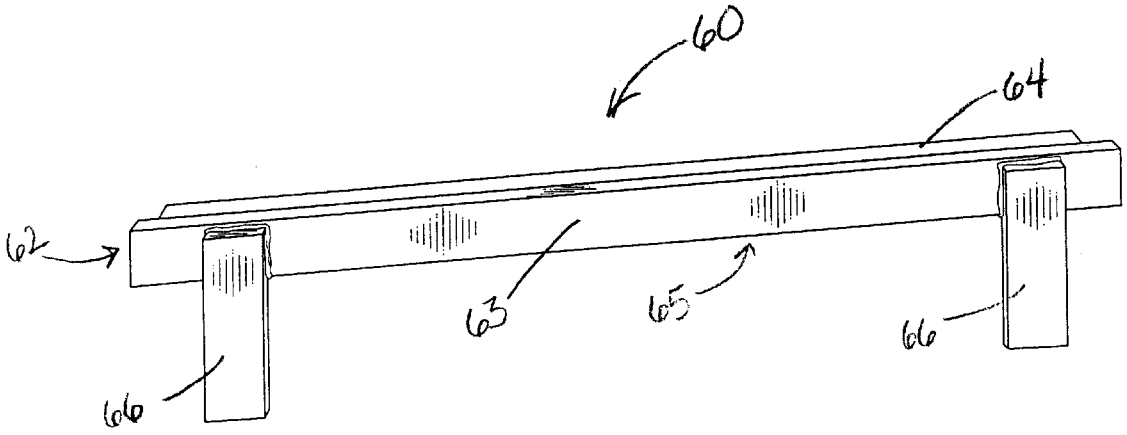
FIG. 6 is a rear view of the deflector which may be included in the preferred embodiment of the invention.

As illustrated in FIGS. 1, 2 and 6, the preferred embodiment of the present invention includes a filter bag 38 constructed of a fabric which permits water to flow freely therethrough while capturing the silt in the water within the bag. The filter bag 38 includes two pairs of opposite sides 40 and 42, an open top end 44 and a closed bottom end 46. Each pair of sides 40, 42 include a pocket 48 at the top end 44 for receiving the lengthwise and transverse support bars 28, 32 therethrough. The lengthwise support bars 28 are received through each pocket 48 of one pair of sides 40 and the transverse support bars 32 are received through each pocket 48 of the other pair of sides 42 of the filter bag 38. In the preferred embodiment, the width of each pair of sides 40, 42 of the filter bag 38 at the bottom end 46 is less than the width of each pair of sides 40, 42 at the top end 44. With the support bars 28, 32 inserted, the two pairs of opposite sides 40, 42 are suspended downwardly into the catch basin 10 and no portion of the filtration system 20 extends above the grate 16.

In the preferred embodiment, a portion of each end rail 24 extends downwardly into the catch basin 10. As shown in FIGS. 3 and 5, each end rail 24 includes a first portion 50 and a second portion 52 which is attached to the first portion 50 and extends downward therefrom whereby each end rail 24 is substantially L-shaped. When installed in the catch basin 10, the first portion 50 is adjacent to the top of the drain opening 14 and is mounted to the fixed frame 12 and the second portion 52 extends a predetermined distance D downward into the catch basin 10. The ends 27 of the side rails 26 are connected to the second portion 52 at each end 25 of the end rails 24 so that the side rails 26 are positioned the predetermined distance D below the drain opening at the top of the catch basin 10. The connection between the side rails 26 and the end rails 24 define four inner corners 54 of the base frame 22. As best seen in FIG. 5, each holder 30 includes a recess 56 for receiving the lengthwise support bars 28 therein. In the present invention embodiment, the holders 30 are positioned adjacent to the side rails 26 and the recesses 30 extend below the predetermined distance D at which the side rails are positioned such that the lengthwise support bars 28 supported therein are disposed adjacent to and in substantial horizontal alignment with the side rails 26. In the preferred embodiment, the holders 30 are attached to the base frame 22 at each inner corner 54.

Figure 8:
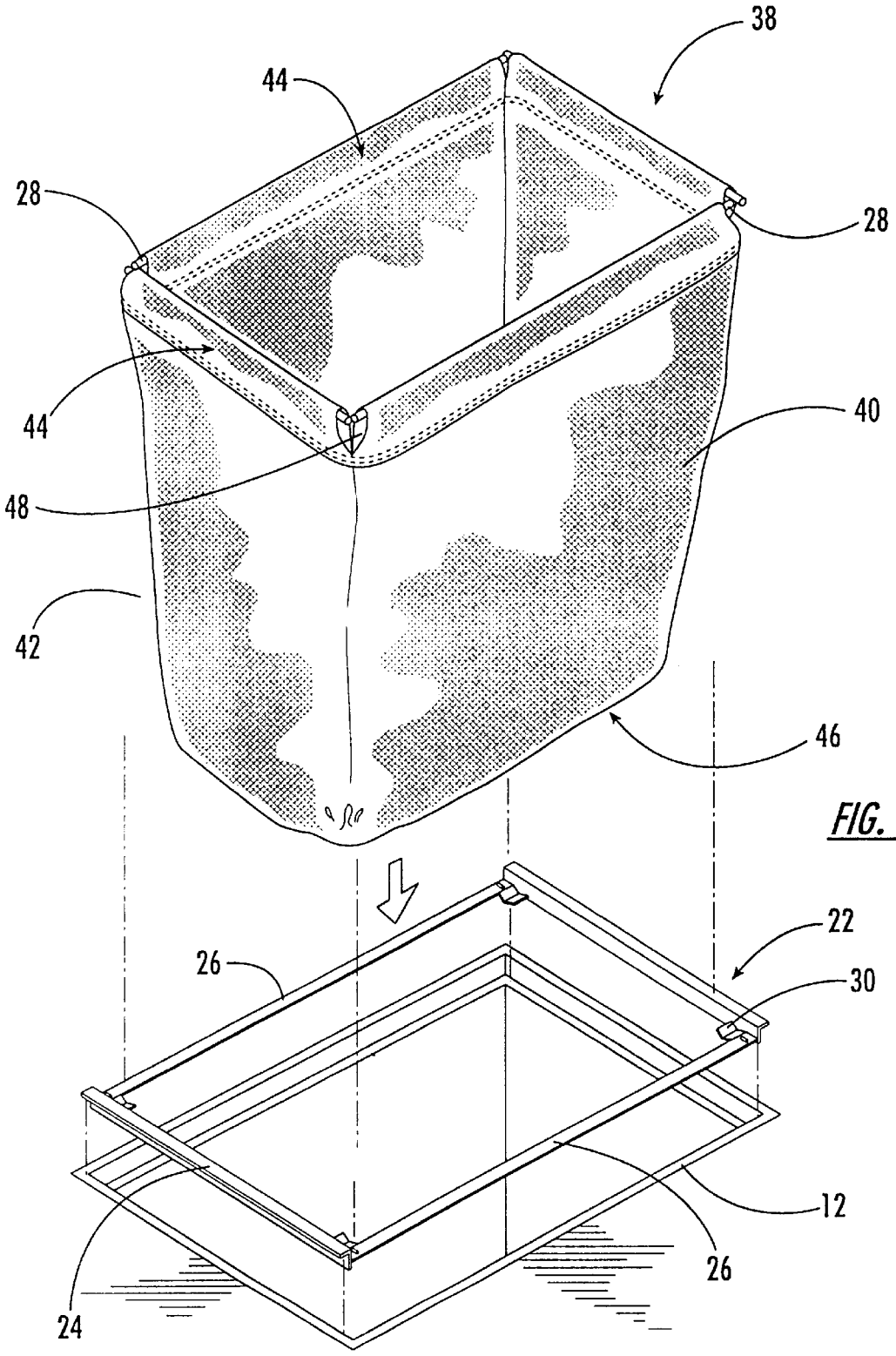
FIG. 8 is a perspective view of the preferred embodiment showing the filter bag including the lengthwise support rods being lowered onto the base frame.
Figure 9:
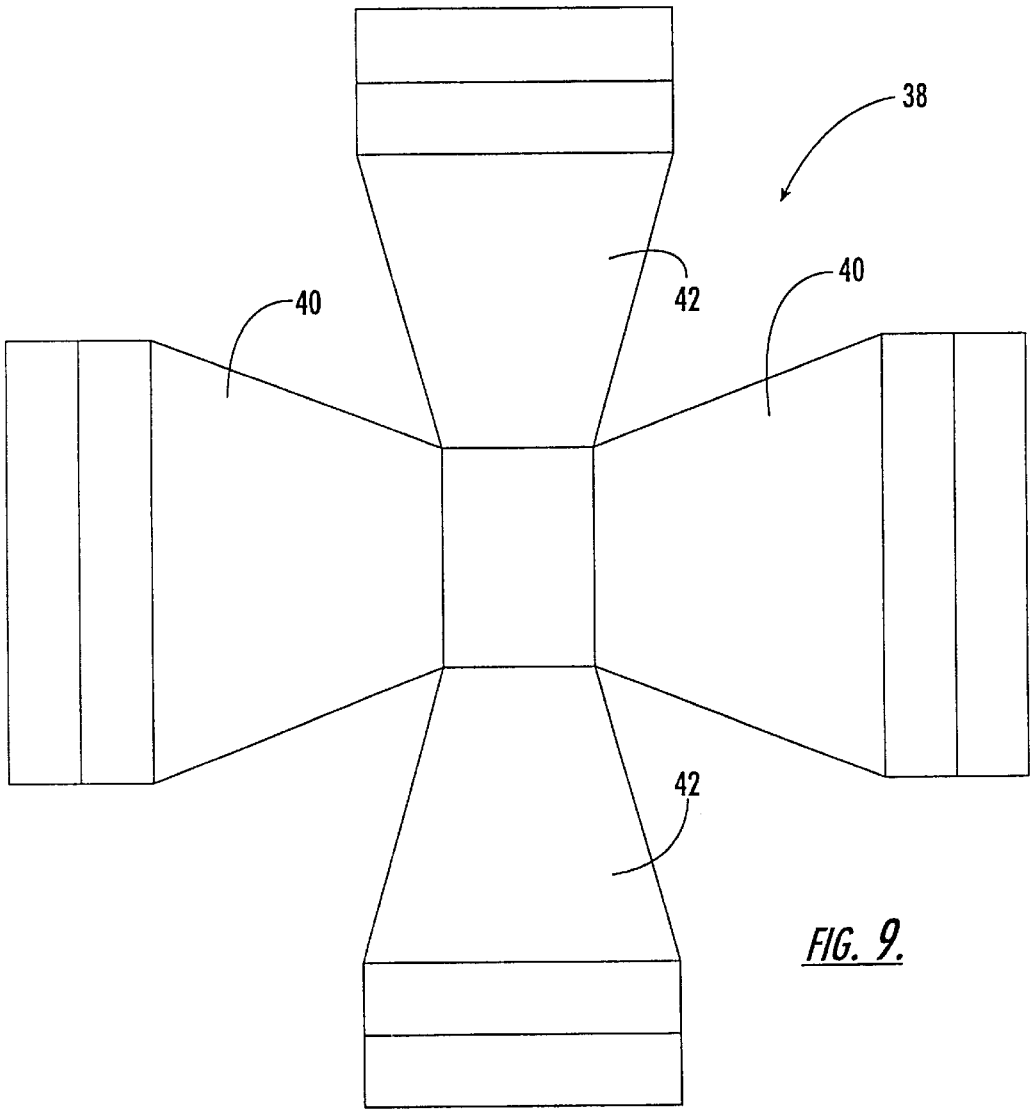
FIG. 9 is a top view of a pattern for constructing the filter bag of the preferred embodiment of the invention.

In use, the entire si lt filtration system 20 is positioned beneath the grate 16 and below the street level. The system 20 is easily installed by lifting the grate 16 from the street curb drain and placing the base frame 22 on the fixed frame 12 on which the grate 16 normaly rests. The lengthwise support bars 28 are inserted through the pockets or sleeves 48 of one pair of opposite sides 40 of the filter bag 38. Holding lengthwise support bars 28, the filter bag 38 is dropped into the catch basin 10 as shown in FIG. 8. The lengthwise support bars 28 are lowered onto the base frame with the ends 29 positioned within and supported by the holders or brackets 30. The transverse support bars 32 are inserted through the sleeves 48 of the remaining pair of opposite sides 42 of the filter bag 38 and positioned over the lengthwise support bars 28. The transverse sedupport bars 32 are secured in place adjacent to each end rail 24 by placing the bars within channels 36. Thus, the configuration of the lengthwise support bars 28 and transverse support bars 32 of the present invention provides a system which advantageously supports all four sides of the filter bag 38 to securely suspend the filter bag 38 in the catch basin yet allows the filter bag 38 to be easily removed and emptied. Once the system is in place, the grate 16 is replaced and the entire silt filtration system fits beneath the grate and below the street level.

Figure 7:
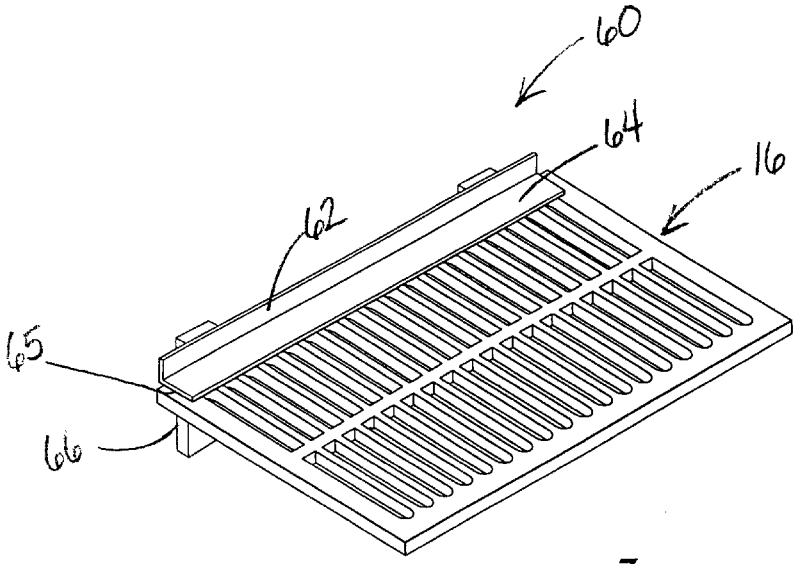
FIG. 7 is a perspective view of the deflector in use and positioned on the grate.

As shown in FIGS. 2, 6 and 7, the preferred embodiment of the subject invention may also include a removably positionabled eflector 60 for deflecting silt and/or sediment and the like over the grate 16 and into the filter bag 38 of the silt filtration system 20. The deflector 60 includes an elongated lengthwise rail having a first portion 62 with a rear surface 63 and a second portion 64 with a bottom surface 65. In use, after the silt filtration system 20 is in place, the deflector 60 is positioned on the grate 16 adjacent to the curb with the bottom surface 65 of the second portion 64 resting flat on the grate 16 and the rear surface 63 of the first portion 62 adjacent to the curb. In the preferred embodiment, the deflector 60 is substantially L-shaped and extends for the length of the grate 16. The deflector 60 also includes means for holding the deflector 60 in place, such means including at least one bar 66 attached to the first portion 62. As best seen in FIGS. 6 and 7, in the preferred embodiment, a pair of spaced-apart bars 66 are attached to the rear surface 63 and extend downwardly therefrom into the catch basin to secure the deflector 60 in place. Thus, the deflector 60 may be quickly and easily installed on the grate for increasing the effectiveness of the subject invention by directing the flow of silt and/or sediment and the like into the filter bag 38 of the silt filtration system 20.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof without departing from the substance or scope of the present invention. Accordingly, while the invention has been described herein in detail in relation to its preferred embodiment, it is to be understood that this disclosure is only illustrative and exemplary or the present invention and is made merely for purposes of provided a full and enabling disclosure of the invention. The foregoing discussion is not intended or to be construed to limit the present invention of otherwise to exclude any such other embodiments, adaptations, variations, modifications and equivalent arrangements, the present invention being limited only by the claims appended hereto and the equivalents thereof.

I claim:

1. A silt filtration system for filtering silt from wastewater flowing into street curb drains having a storm water catch basin including a fixed frame with a drain opening at the top of the catch basin and a grate covering the drain opening, said filtration system comprising:

a. a pair of spaced-apart end rails mountable beneath the grate and a pair of spaced-apart side rails extending between and connecting said end rails to form a substantially rectangular-shaped base frame adapted to fit within the fixed frame at the top of the catch basin;

b. a pair of lengthwise support bars removably positioned within said base frame and extending between said end rails;

c. a plurality of holders attached to said base frame for receiving and supporting said lengthwise support bars;

d. a pair of transverse support bars removably positioned transversely over said lengthwise support bars on said side rails and adjacent to said end rails; and e. a filter bag including two pairs of opposite sides and an open top end, each side having a pocket at said top end for receiving said lengthwise support bars through one pair of opposite sides and said transverse support bars through the other pair of opposite sides, wherein said two pairs of opposite sides of said filter bag are suspended downwardly into the catch basin and no portion of said filtration system extends above the grate.

2. The silt filtration system of claim 1, wherein said side rails and said holders are positioned a predetermined distance below the drain opening whereby said lengthwise and transverse support bars positioned thereon are disposed below the top of the catch basin beneath the grate.

3. The silt filtration system of claim 1, wherein each holder includes a recess adapted to receive and support said lengthwise support bars therein.

4. The silt filtration system of claim 2, wherein a portion of each end rail extends downwardly into the catch basin for positioning said side rails at said predetermined distance below the drain opening.

5. The silt filtration system of claim 4, wherein each end rail includes a first portion adjacent to the drain opening and mountable to the fixed frame of the catch basin and a second portion attached to said first portion, said second portion extending downwardly into the catch basin.

6. The silt filtration system of claim 5, wherein each end rail is substantially L-shaped.

7. The silt filtration system of claim 3, wherein said holders are positioned adjacent to said side rails and said recesses extend therebelow whereby said lengthwise support bars supported there on are disposed in substantial horizontal alignment with said side rails.

8. The silt filtration system of claim 7, wherein said base frame includes four inner corners formed at the connection between said side rails and said end rails, said holders being attached to said base frame at said inner corners and positioned to receive said lengthwise bars within said recesses.

9. The silt filtration system of claim 3, wherein each recess is substantially v-shaped.

10. The silt filtration system of claim 3, wherein each side rail includes a plurality of raised portion, each raised portion forming a channel between said raised portion and each end rail for holding said transverse support bars therein.

11. The silt filtration system of claim 1, wherein each side of said filter bag includes a bottom end having a width less than the width of said side at said top end.

12. The silt filtration system of claim 1, further including means positionable above the grate for deflecting silt and/or sediment and debris or other pollutants over the grate and into said filter bag.

13. The silt filtration system of claim 12, wherein said means includes a lengthwise rail having a first portion positionable adjacent to a street curb and a second portion positionable on the grate.

14. The silt filtration system of claim 13, wherein said lengthwise rail is substantially L-shaped and extends for substantially the length of the grate.

15. The silt filtration system of claim 13, wherein said first portion includes a rear surface and said second portion includes a bottom surface and said bottom surface rests flat on the grate and said rear surface is adjacent to the street curb.

16. The silt filtration system of claim 13, further including at least one bar attached to said first portion and extending downwardly into the catch basin for holding said lengthwise rail in place on the grate adjacent to the curb.

17. The silt filtration system of claim 16, wherein said at least one bar includes a pair of spaced apart bars attached to said rear surface of said first portion.

18. A method for capturing and removing silt in a street curb drain having a storm water catch basin including a fixed frame with a drain opening at the top of the catch basin and a grate covering the drain opening, the method comprising the steps of:

a. providing a silt filtration system including a base frame adapted to fit within the fixed frame at the top of the catch basin and a pair of lengthwise support bars removably positioned on a plurality of brackets attached to said base frame and a pair of transverse support bars removably positioned transversely over said lengthwisc support bars; and a filter bag including two pairs of opposite sides and an open top end, each pair of sides having a sleeve at said top end for receiving said lengthwise support bars and said transverse support bars therethrough;

b. lifting said grate from the drain;

c. placing said base frame into said catch basin on said fixed frame on which said grate normally rests;

d. inserting said lengthwise support bars through said sleeves;

e. holding said lengthwise support bars and dropping said filter bag into said catch basin;

f. positioning said lengthwise support bars into said brackets;

g. inserting said transverse support bars through said sleeves and positioning said transverse support bars over said lengthwise support bars; and h. re-installing said grate over said drain opening whereby no portion of the system extends above said grate.

19. The method of claim 18, wherein the base frame includes a plurality of channels adapted to receive and hold said transverse support bars in place on said base frame and the step of positioning said transverse support bars over said lengthwise support bars further includes placing said transverse support bars in said channels to secure said transverse support bars thereon.

20. The method of claim 18, further including the step of lifting said lengthwise and transverse support bars to remove said filter bag from said catch basin and removing captured silt from said bag.

21. The method of claim 18, further including the step of providing a deflector for deflecting silt and/or sediment and debris or other pollutants over said grate and into said filter bag and positioning said deflector on said grate adjacent to the street curb after said grate has been reinstalled over said drain opening.

* * * * *